US007886819B2

(12) United States Patent
Setterberg, Jr. et al.

(10) Patent No.: US 7,886,819 B2
(45) Date of Patent: Feb. 15, 2011

(54) SHUNT TUBE CONNECTOR LOCK

(75) Inventors: John Richard Setterberg, Jr., Huntsville, TX (US); Alejandro Eduardo Perez, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 40 days.

(21) Appl. No.: 12/393,741

(22) Filed: Feb. 26, 2009

(65) Prior Publication Data

US 2009/0159270 A1 Jun. 25, 2009

Related U.S. Application Data

(62) Division of application No. 11/154,180, filed on Jun. 16, 2005, now Pat. No. 7,497,267.

(51) Int. Cl.
*E21B 43/04* (2006.01)
*E21B 43/08* (2006.01)

(52) U.S. Cl. ..... 166/227; 166/242.6

(58) Field of Classification Search ..... 166/242.6, 166/236, 227

See application file for complete search history.

(56) References Cited

U.S. PATENT DOCUMENTS 3,036,635 A * 5/1962 Corley, Jr. et al. ..... 166/67
4,258,793 A * 3/1981 McGraw et al. ..... 166/374
5,092,364 A * 3/1992 Mullins ..... 137/614.05
5,255,714 A * 10/1993 Mullins ..... 137/614.04
5,341,880 A * 8/1994 Thorstensen et al. ..... 166/278
5,390,966 A * 2/1995 Cox et al. ..... 285/124.2
5,476,143 A * 12/1995 Sparlin et al. ..... 166/233
5,515,915 A * 5/1996 Jones et al. ..... 166/51
5,518,072 A * 5/1996 McTernaghan ..... 166/115
5,566,772 A * 10/1996 Coone et al. ..... 175/321
5,996,712 A * 12/1999 Boyd ..... 175/321
6,053,250 A * 4/2000 Echols ..... 166/317
6,213,206 B1 * 4/2001 Bakke ..... 166/242.7
6,367,552 B1 * 4/2002 Scott et al. ..... 166/355
6,425,443 B1 * 7/2002 Hill et al. ..... 166/377
6,561,551 B2 * 5/2003 Kawakami et al. ..... 285/316
6,684,514 B2 * 2/2004 Welch ..... 30/367
6,715,545 B2 * 4/2004 McGregor et al. ..... 166/235
6,923,262 B2 * 8/2005 Broome et al. ..... 166/278
7,174,963 B2 * 2/2007 Bertelsen ..... 166/376
2003/0159825 A1 * 8/2003 Hurst et al. ..... 166/278
2004/0045704 A1 * 3/2004 Bowles ..... 166/242.7
2005/0082060 A1 * 4/2005 Ward et al. ..... 166/278

* cited by examiner

*Primary Examiner*—Shane Bomar
*Assistant Examiner*—Robert E Fuller
(74) *Attorney, Agent, or Firm*—Wong, Cabello, Lutsch, Rutherford & Brucculeri LLP

(57) ABSTRACT

A locking mechanism for securing a jumper tube to a shunt tube in a well screen assembly for use in gravel packing is disclosed. The jumper tube features a telescoping connector that extends to engage the shunt tube and a locking mechanism that extends the connector the proper distance and then locks the connector into place by engaging lugs that are connected to the jumper tube. Also disclosed is an apparatus and method for securing a connector tube to a well screen assembly using a receiver that is attached to the well screen assembly and is configured to receive a connector tube and secure the connector tube into place with screws. The receiver can be mounted to the well screen assembly via the shunt tube, a top/middle-bottom ring assembly, directly to the base pipe.

5 Claims, 5 Drawing Sheets

SHUNT TUBE CONNECTOR LOCK

This application is a divisional of U.S. patent application Ser. No. 11/154,180, now U.S. Pat. No. 7,497,267 the entire contents of which are incorporated herein by reference.

FIELD OF THE INVENTION

The invention relates to particulate control in petroleum production wells, and more specifically to alternate path sand control completions. In particular, the invention relates to securing a shunt tube connector to a jumper tube and securing a shunt tube connector to a screen assembly.

BACKGROUND OF THE INVENTION

Production of hydrocarbons from loosely or unconsolidated and/or fractured formations often produces large volumes of particulate material along with the formation fluids. These particulates can cause a variety of problems. Gravel packing is a common technique for controlling the production of particulates (e.g. sand).

Gravel pack completion involves lowering a screen on a workstring into the well bore and placing the screen adjacent to the subterranean formation. Particulate material, collectively referred to as "gravel", and a carrier fluid is pumped as a slurry down the workstring where it exits through a "crossover" into the well annulus formed between the screen and the well bore.

The carrier liquid in the slurry normally flows into the formation and/or through the screen, itself, which, in turn, is sized to prevent gravel from flowing through the screen. This results in the gravel being deposited or "screened out" in the annulus between the screen and the well bore and forming a gravel-pack around the screen. The gravel, in turn, is sized so that it forms a permeable mass which allows produced fluids to flow through the mass and into the screen but blocks the flow of particulates into the screen.

It is often difficult to completely pack the entire length of the well annulus around the screen. This poor distribution of gravel (i.e. incomplete packing of the interval) is often caused by the carrier liquid in the gravel slurry being lost into the more permeable portions of the formation interval which, in turn, causes the gravel to form "sand bridges" in the annulus before all of the gravel has been placed. Such bridges block farther flow of slurry through the annulus thereby preventing the placement of sufficient gravel (a) below the bridge in top-to-bottom packing operations or (b) above the bridge in bottom-to-top packing operations.

Alternate flow conduits, called shunt tubes, alleviate this problem by providing a flow path for the slurry around sand bridges. The shunt tubes are typically run along the length of the well screen and are attached to the screen by welds. Once the screen assemblies are joined, fluid continuity between the shunts on adjacent screen assemblies must be provided. Several methods have been attempted to provide such continuity.

U.S. Pat. No. 6,409,219, by Broome et al. describes a system wherein shunts on adjacent assemblies aligned when the correct torque is applied to join the assemblies. Alignment marks are included on the assemblies to indicate when the correct torque has been applied.

U.S. Pat. No. 5,341,880, by Thorstensen et al. describes a sand screen structure assembled from a plurality of generally tubular filter sections that may are axially snapped together in a manner facilitating the simultaneous interconnection of circumferentially spaced series of axially extending shunt tubes secured to and passing internally through each of the filter sections. In an alternate embodiment of the sand screen structure the shunt tubes are secured within external side surface recesses of the filter section bodies.

U.S. Pat. No. 5,868,200, by Bryant et al. describes an alternate-path, well screen made-up of joints and having a sleeve positioned between the ends of adjacent joints which acts as a manifold for fluidly-connecting the alternate-paths on one joint with the alternate-paths on an adjacent joint.

Another configuration known in the art uses screen assemblies having shunts that stop a certain length from the ends of the screen assemblies to allow handling room when the screen assemblies are joined together. Once the screen assemblies are joined, their respective shunt tubes are linearly aligned, but there is a gap between them. Continuity of the shunt tube flow path is typically established by installing a short, presized tube, called a jumper tube, in the gap. The jumper tube features a connector at each end that contains a set of seals and is designed to slide onto the end of the jumper tube in a telescoping engagement. When the jumper tube is installed into the gap between the shunt tubes, the connector is driven partially off the end of the jumper tube and onto the end of the shunt tube until the connector is in a sealing engagement with both tubes. The shunt tube flow path is established once both connectors are in place. A series of set screws engage both the jumper tube and shunt tube. The screws are driven against the tube surfaces, providing a friction lock to secure the connector in place. This connection is not very secure and there is concern that debris or protruding surfaces of the well bore could dislodge the connectors from sealing engagement with the tubes while running the screens into the well bore. Therefore, a device called a split cover is typically used to protect the connectors. A split cover is a piece of thin-gauge perforated tube, essentially the same diameter as the screen assembly, and the same length as the gap covered by the jumper tubes. The perforated tube is spit into halves with longitudinal cuts. The halves are rejoined with hinges along one seam and locking nut and bolt arrangements along the other seam. The split cover can be opened, wrapped around the gap area between the assemblies, and then closed and secured with the locking bolts. Split covers have several disadvantages: they are expensive, they must be sized to fit a particular gap length and therefore care must be taken to insure that the correct lengths are sent to the well site, they are awkward to install, and they are not very robust and can suffer damage when they are run into the well.

SUMMARY OF THE INVENTION

An aspect of an embodiment of the present invention provides a locking mechanism for securing a jumper tube to a shunt tube. The jumper tube has a set of lugs in proximity to the end of the tube. A tubular connector is configured on the jumper tube between the lugs and the end of the jumper tube. The connector is extendable to engage a shunt tube in a telescoping arrangement. A connector lock is configured on the jumper tube on the side of the lugs opposite the connector such that moving the connector lock in the direction of the connector extends the connector beyond the end of the jumper tube. The connector lock has slots configured to engage the lugs such that the lugs contact the backs of the slots when the connector is extended an appropriate length beyond the end of the jumper tube to effectively engage a shunt tube. Contact between the lugs and the backs of the slots prevent the connector lock from moving further in the direction of the connector. The connector lock has screws configured to secure the lugs in the slots by trapping the lugs between the screws and the backs of the slots.

An embodiment of the present invention also provides an alternate path well screen apparatus having a base pipe, a screen section attached to the outer surface of the base pipe and extending about a portion of the circumference of the base pipe, and a shunt tube connected to the base pipe via a top/middle-bottom ring assembly and extending along the length of the screen section. The alternate path well screen apparatus features a receiver that is configured to accept a connector tube and secure the connector tube to the well screen apparatus via screws and mating holes in the connector tube. The receiver can be attached to the shunt tube, the top/middle-bottom ring assembly, or the base pipe.

DETAILED DESCRIPTION OF THE INVENTION

Figure 1:
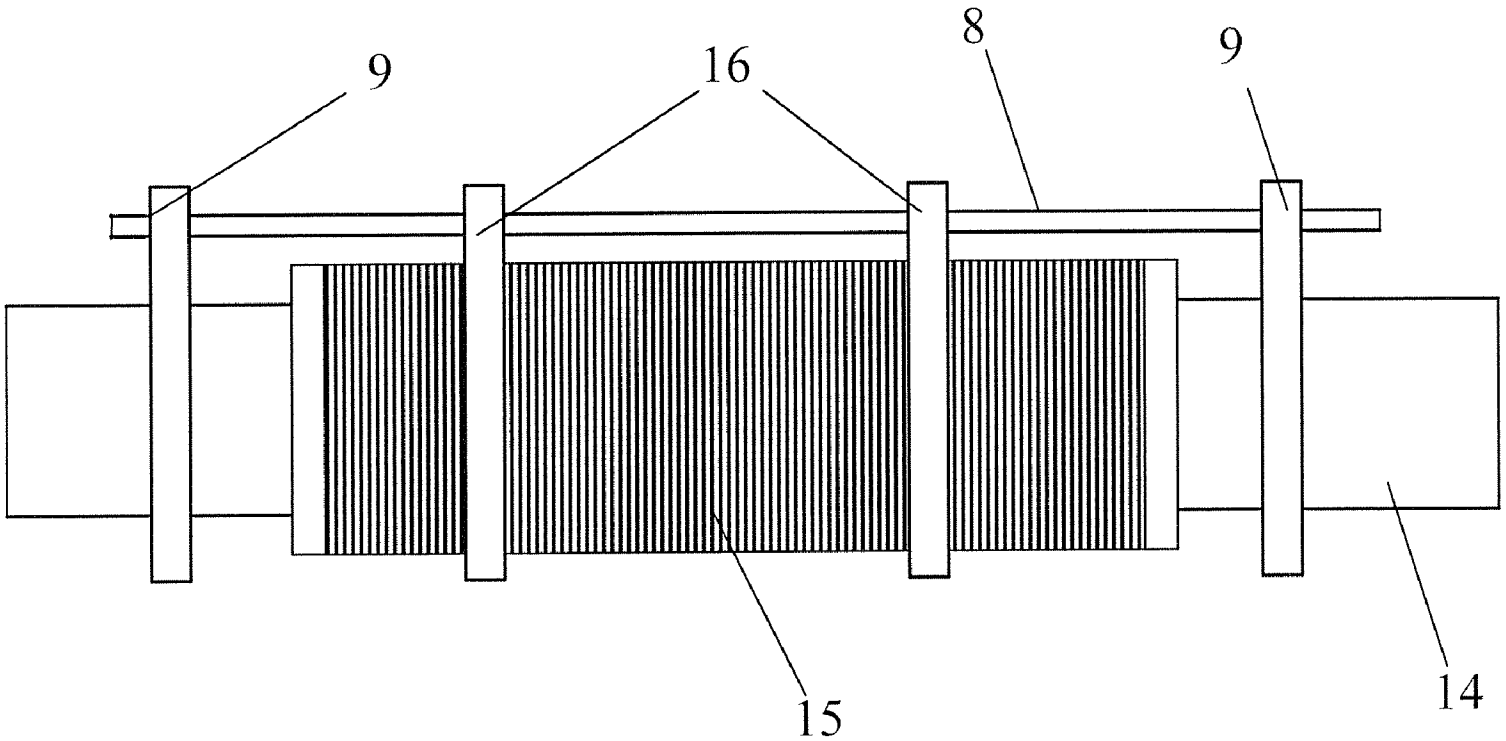
FIG. 1 depicts a generalized well screen assembly according to the present invention.

FIG. 1 shows a generalized well screen assembly according to the present invention. The assembly includes a base pipe 14 and a screen section 15 attached to the outer surface of the base pipe. The assembly also features a shunt tube 8 attached to base pipe 14 via top/middle-bottom rings 9 and attached to the screen section via rings 16 (referred to herein as B-rings).

An embodiment of the present invention provides an apparatus for securing a jumper tube to a shunt tube. This embodiment uses jumper tubes featuring a connector that is designed to slide onto the end of the jumper tube in a telescoping engagement. When the jumper tube is installed into the gap between the shunt tubes, the connector is driven partially off of the end of the jumper tube and onto the end of the shunt tube to form a sealing engagement between both tubes. As used herein, "first position" refers to the configuration before the connector has been extended and "second position" refers to the configuration when the connector has been extended as when the connector forms a sealing engagement with the shunt tube.

Figure 2:
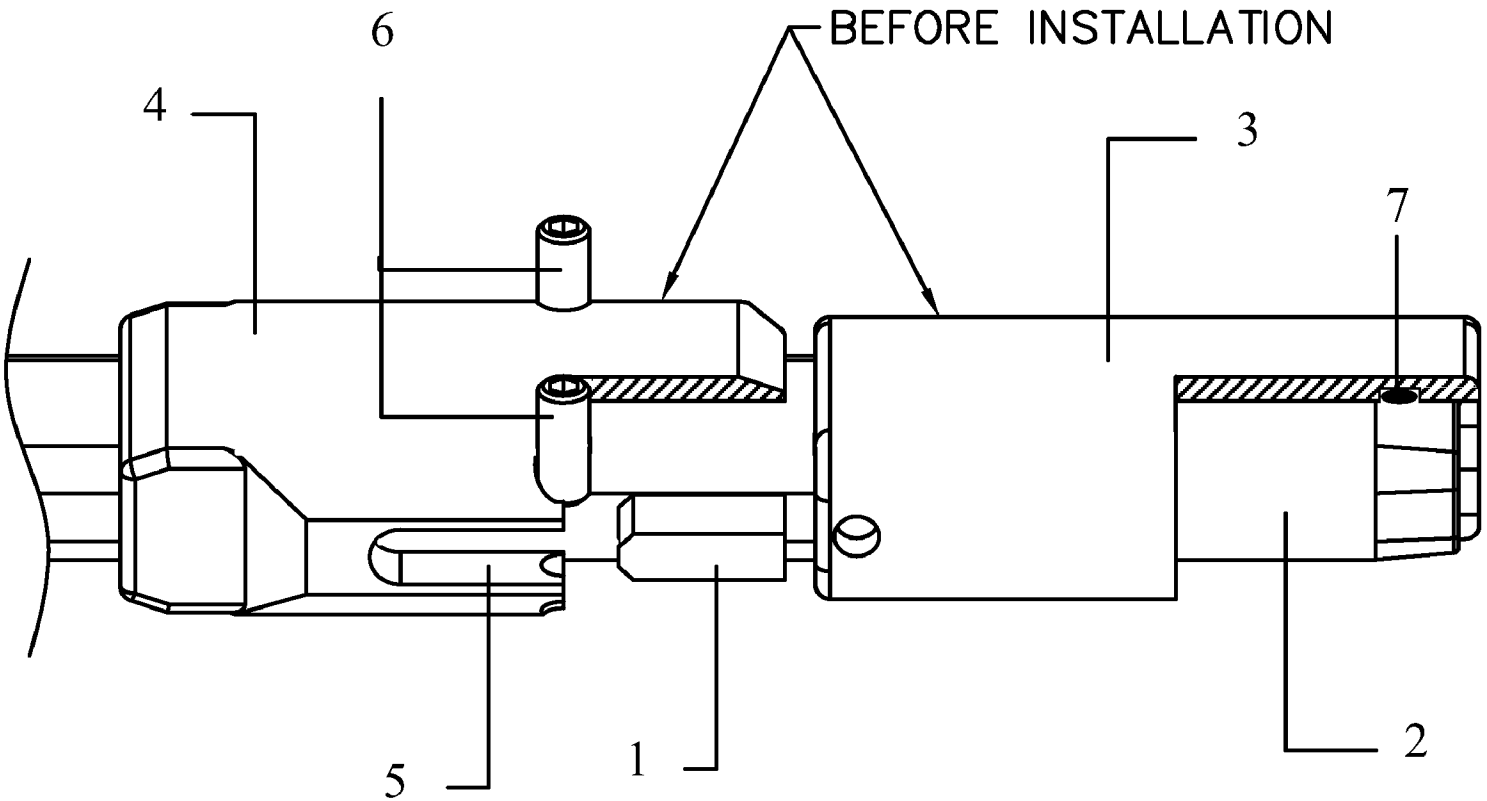
FIG. 2 depicts a locking mechanism in the "first position" according to an embodiment of the present invention.

FIG. 2 depicts one embodiment of the invention. Lugs 1 (only one lug is visible in this view) are connected to jumper tube 2 in proximity to the position of the end of connector 3 when the connector is in the first position. Connector 3 is shown as a cut-away so that jumper tube 2 can be seen. Lugs 1 are attached to jumper tube 2, for example, with welds. Connector lock 4 is positioned on the main body of tube 2, on the opposite side of lugs 1 from the end of the tube. Connector lock 4 is able to slide on tube 2. Connector lock 4 features slots 5 configured to engage lugs 1. The length of the slots limits the extent to which connector lock 4 can slide in the direction of connector 3 because lock 4 can no longer move in that direction when lugs 1 contact the back of the slots. The slot length is set to correspond to the amount of travel required by connector 3 when it is moved to the second position to form a sealing engagement with a shunt tube. Jumper tube 2 can include a sealing ring 7 to contact the shunt tube. As connector 3 moves to the second position, lock 4 follows, thereby engaging lugs 1 in slots 5. Lock 4 features a set of screws 6 with axes perpendicular to slots 5. Screws 6 are positioned such that they are on the body side of lugs 1 when connector 3 is in the first position and on the connector side of lugs 1 when the connector is in the second position. The screws are driven in when connector 3 is in the second position, effectively securing lugs 1 between screws 6 and the back of the slots 5. Lock 4 is thereby secured in this position on jumper tube 2 and connector 3 is likewise secured in the second position, trapped between lock 4 and the screen assembly (not shown).

Figure 3:
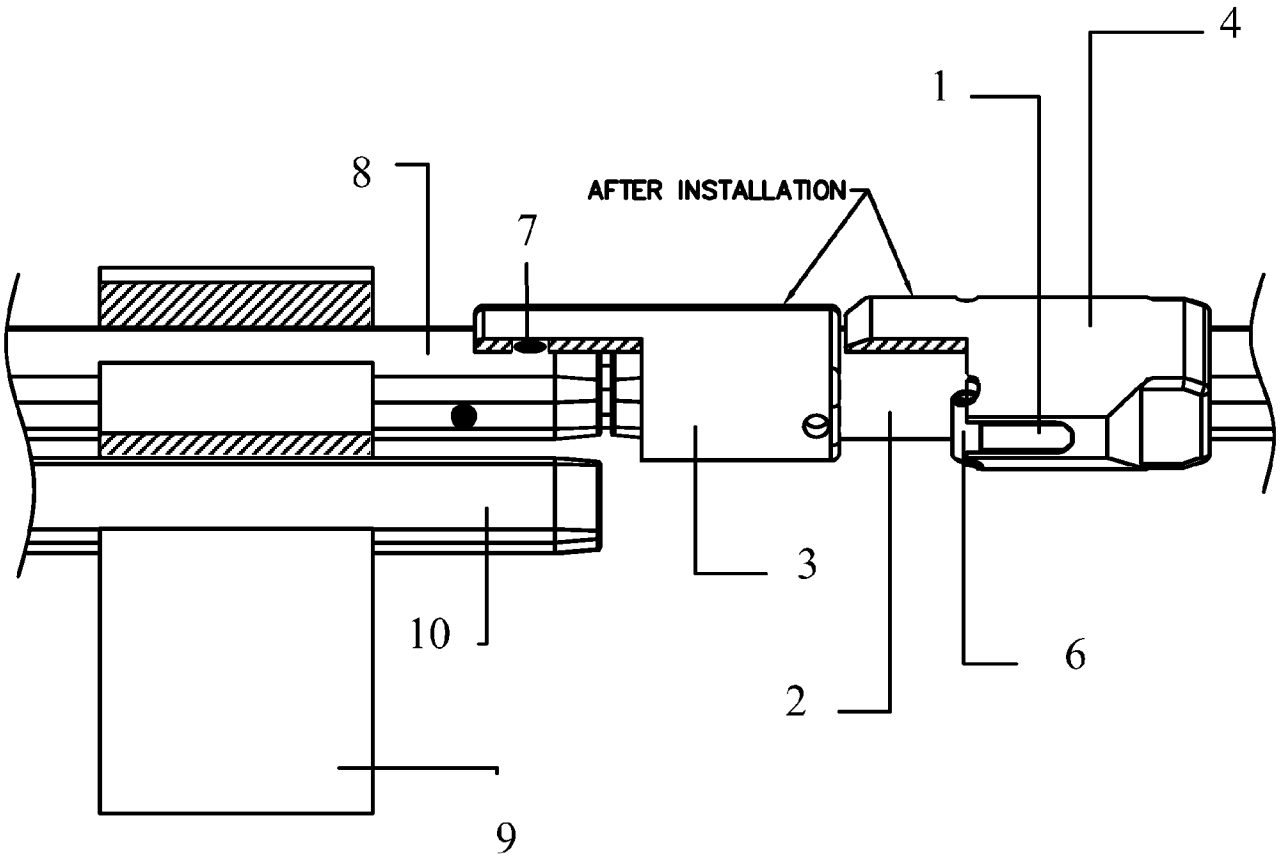
FIG. 3 depicts a locking mechanism in the locked position (i.e., the "second position") according to an embodiment of the invention.

FIG. 3 depicts an embodiment wherein connector 3 is engaged with a shunt tube 8 (i.e., "second position") and connector lock 4 is secured into place by screws 6. The shunt tube depicted in FIG. 3 is typically secured to the screen assembly top/middle-bottom rings 9. FIG. 3 also depicts tube 10, which is in fluid contact with shunt tube 8, for example via nozzles (not shown). Tube 10 is typically configured to deliver gravel into the annulus between the screen assembly and the borehole. Screws 6 are driven in to secure lock 4 in the proper position to maintain connector 3 in the second position.

An alternative to securing the connector tube to the jumper tube is to secure the connector to the screen assembly. For example, in the embodiment depicted in FIG. 4, the connector is secured to the screen assembly via shunt tube 8. Shunt tube 8 is configured with a "C"-shaped receiver 11 positioned with the open side of the "C" toward the end of the tube. Receiver 11 is positioned to receive connector 3 when connector 3 is driven into the second position. Connector 3 is attached to jumper tube 2. Receiver 11 features set screws 12 that align with mating holes (not apparent in this view) in connector 3. The set screws can be driven in when connector 3 is in the second position thereby securing connector 3 in place. As used herein, "screw" is understood to include any variety screwing of fastener such as screws, bolts, etc.

Figure 4:
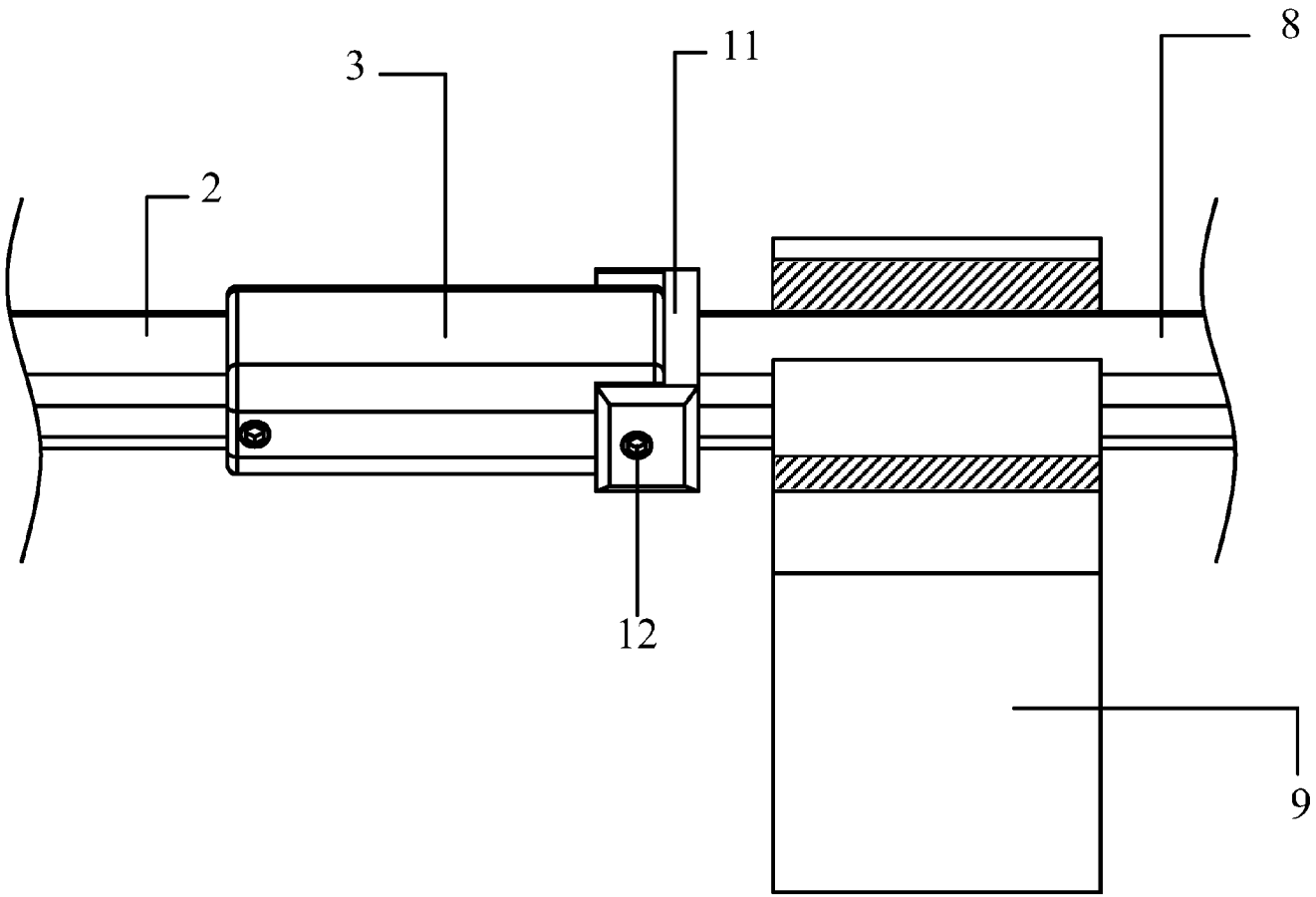
FIG. 4 depicts a mechanism for securing a jumper tube connector to a screen assembly using a clamp fixed to a shunt tube.
Figure 5:
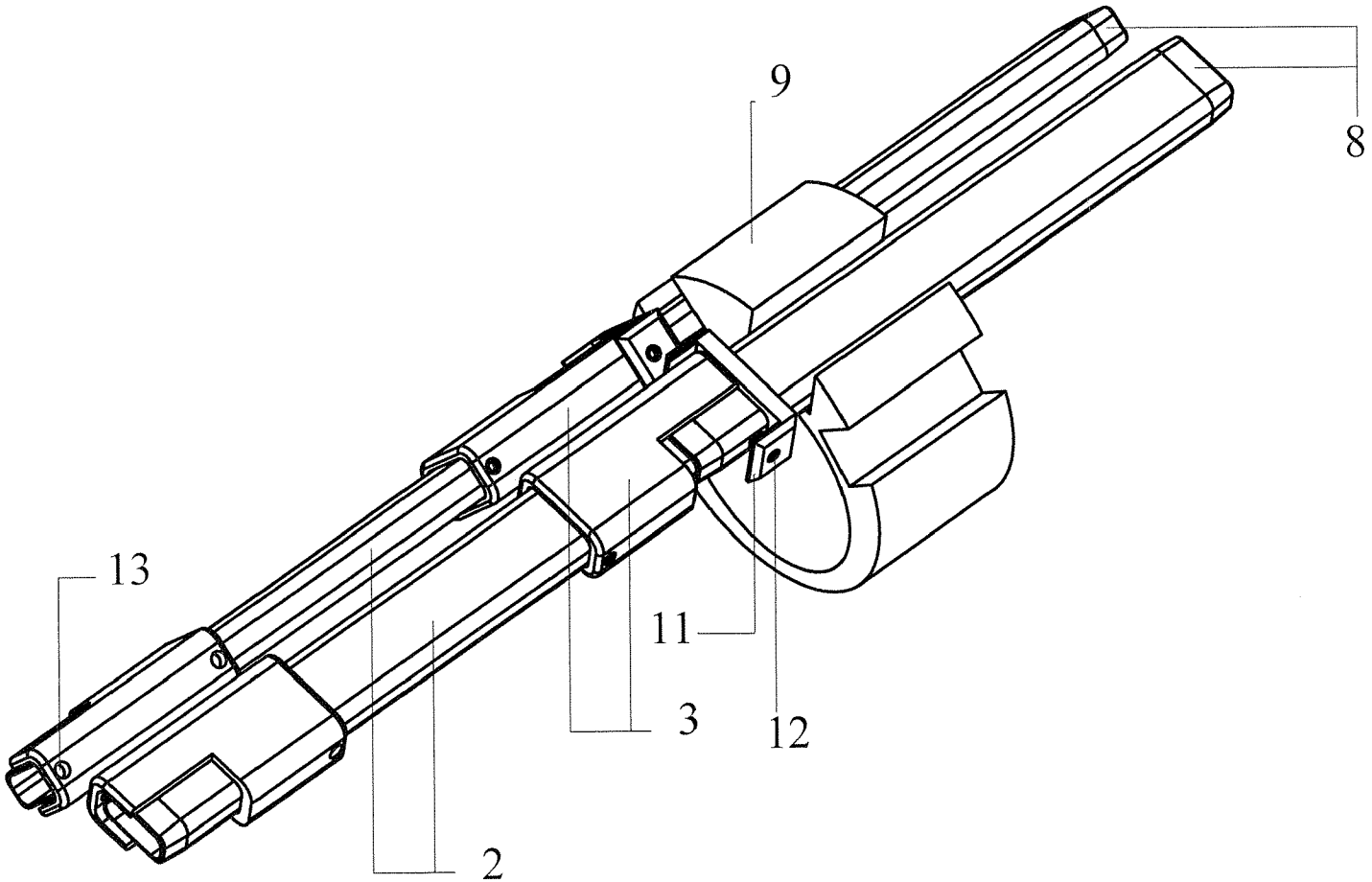
FIG. 5 depicts an embodiment of the invention having a clamps attached to the shunt tubes. The clamps are situated to receive connectors and secure the connectors using screws that match with mating holes on the connectors.

FIG. 5 shows a different view of the embodiment depicted in FIG. 4. Mating holes 13 are apparent in this view. The embodiment depicted in FIGS. 4 and 5 have the C-shaped receiver 11 fixed as part of shunt tube 8. One of skill in the art will appreciate that many other configurations are possible. For example, the receiver could be part of top/middle-bottom ring 9 instead of shunt tube 8. Likewise, receiver could be secured to the screen assembly via the base pipe.

One of skill in the art will appreciate that it may be desirable to secure the connector to the jumper tube and to the screen assembly. For example, the connector can be secured to the jumper tube using a locking mechanism and a shunt tube having lugs, as described above, and also securing the connector to the screen assembly.

It should be understood that the inventive concepts disclosed herein are capable of many modifications. To the extent such modifications fall within the scope of the appended claims and their equivalents, they are intended to be covered by this patent.

What is claimed is:

1. An alternate path well screen apparatus comprising:

a base pipe having an outer surface, a screen section attached to the outer surface of the base pipe and extending about a portion of the circumference of the base pipe, a shunt tube connected to the base pipe via a top/middle-bottom ring assembly and extending along the length of the screen section, and a receiver that is configured to accept a connector tube of a jumper tube and secure the connector tube to the well screen apparatus via screws and mating holes in the connector tube.

2. The apparatus of claim 1, wherein the receiver is C-shaped.

3. The apparatus of claim 1, wherein the receiver is attached to the shunt tube.

4. The apparatus of claim 1, wherein the receiver is attached to the top/middle-bottom ring assembly.

5. The apparatus of claim 1, wherein the receiver is attached to the base pipe.

* * * * *